US008967052B2

(12) United States Patent
Aspengren et al.

(10) Patent No.: US 8,967,052 B2
(45) Date of Patent: Mar. 3, 2015

(54) RAILCAR CONSTANT CONTACT SIDE BEARING ASSEMBLY

(71) Applicants: Paul B. Aspengren, North Aurora, IL (US); Bradley J. Haymond, Aurora, IL (US); Steve R. White, Maple Park, IL (US); Erich A. Schoedl, Yorkville, IL (US)

(72) Inventors: Paul B. Aspengren, North Aurora, IL (US); Bradley J. Haymond, Aurora, IL (US); Steve R. White, Maple Park, IL (US); Erich A. Schoedl, Yorkville, IL (US)

(73) Assignee: Miner Enterprises, Inc., Geneva, IL (US)

( * ) Notice: Subject to any disclaimer, the term of this patent is extended or adjusted under 35 U.S.C. 154(b) by 155 days.

(21) Appl. No.: 13/862,030

(22) Filed: Apr. 12, 2013

(65) Prior Publication Data

US 2013/0327246 A1 Dec. 12, 2013

Related U.S. Application Data

(63) Continuation-in-part of application No. 13/507,145, filed on Jun. 7, 2012, now Pat. No. 8,807,050.

(51) Int. Cl.
*B61F 5/14* (2006.01)

(52) U.S. Cl.
CPC .. *B61F 5/14* (2013.01); *B61F 5/142* (2013.01)
USPC ..... 105/199.3

(58) Field of Classification Search
USPC ..... 105/182.1, 199.1, 199.3, 200, 211–213; 267/6, 150, 153, 292; 384/420, 423
See application file for complete search history.

(56) References Cited

U.S. PATENT DOCUMENTS

RE34,129 E * 11/1992 Wright ..... 384/423
5,806,435 A * 9/1998 Pitchford ..... 105/199.3

* cited by examiner

*Primary Examiner* — R. J. McCarry, Jr.
(74) *Attorney, Agent, or Firm* — Law Office of John W. Harbst

(57) ABSTRACT

A constant contact side bearing assembly for a railcar including a housing with wall structure defining a central axis for the side bearing assembly and a multipiece cap. The cap is arranged in operable combination with the housing and includes a movable first member and a movable second member carried by the first member. A spring resiliently urges the cap members toward railcar body structure. The cap members define cooperating angled surfaces therebetween for urging wall structure on the first member and wall structure on the second member into frictional engagement with the wall structure on the housing in response to a vertical load acting on the friction contacting surface on the cap. An apparatus, carried by the cap members, allow the cap members to horizontally slide relative to each other while limiting vertical separation of the cap members relative to each other during operation of the constant contact side bearing assembly.

18 Claims, 10 Drawing Sheets

FIG. 10
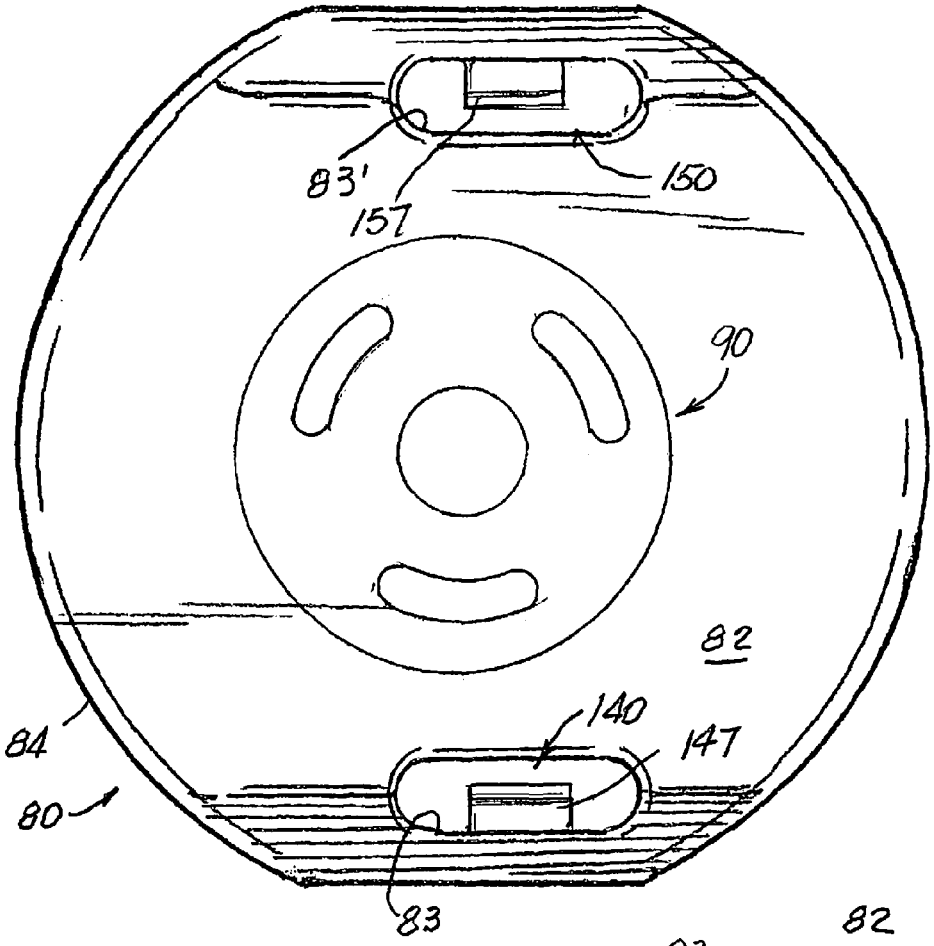
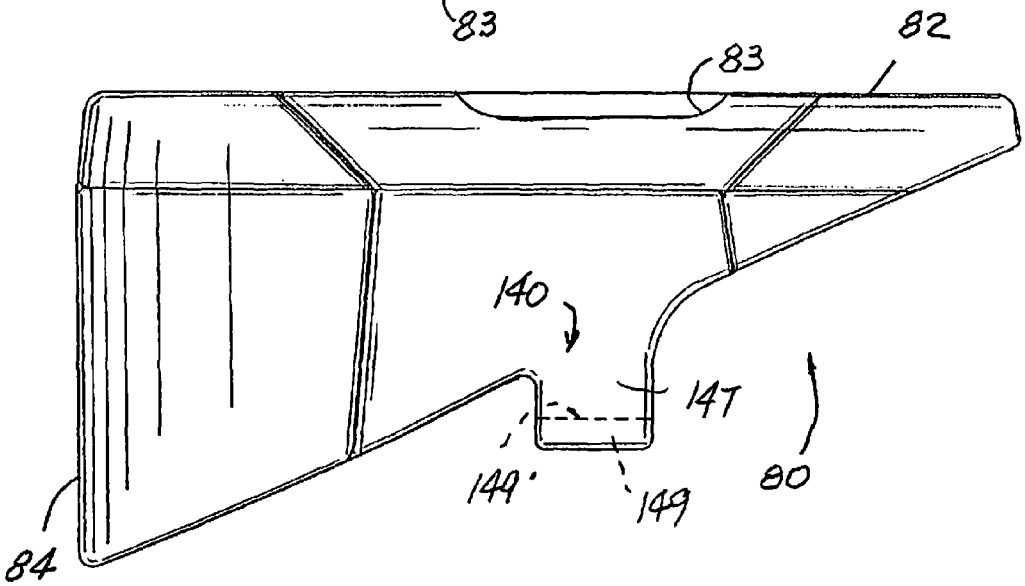
FIG. 11

RAILCAR CONSTANT CONTACT SIDE BEARING ASSEMBLY

RELATED APPLICATION

This application is a Continuation-In-Part of copending and coassigned U.S. patent application Ser. No. 13/507,145; filed Jun. 7, 2012.

FIELD OF THE INVENTION DISCLOSURE

The present invention disclosure generally relates to railroad cars and, more specifically, to a constant contact side bearing assembly for a railroad car.

BACKGROUND

A typical railroad freight car includes a car body supported on a pair of wheeled trucks which are confined to roll on rails or tracks. Each truck includes a bolster extending essentially transversely of the car body longitudinal centerline. In the preponderance of freight cars, a pivotal connection is established between the bolster and railcar body by center bearing plates and bowls transversely centered on the car body underframe and the truck bolster. Accordingly, the truck is permitted to pivot on the center bearing plates under the car body. As the railcar moves between locations, the car body also tends to adversely roll from side to side.

Attempts have been made to control the adverse roll of the railcar body through use of side bearings positioned on the truck bolster outwardly of the center bearing plates. A "gap style" side bearing has been known to be used on slower moving tank/hopper railcars. Conventional "gap style" side bearings include a metal, i.e. steel, block or pad accommodated within an elongated open top pocket or recess defined on the truck bolster. An elongated and upstanding housing or cage, integrally formed with or secured, as by welding or the like, to an upper surface on the truck bolster defines the open top recess and inhibits sliding movement of the metal block relative to the bolster. As is known, a gap or vertical space is usually present between the upper surface of the "gap style" side bearing and the underside of the railcar body.

Other conventional "gap style" side bearings have included roller bearings carried for rolling movements within the elongated housing or carrier mounted on the upper surface of the railcar bolster. The roller extends above an uppermost extent of the housing or carrier and engages with an underside of the railcar body. Such side bearings are able to support the railcar body with respect to the bolster while at the same time permitting the bolster, and therefore the truck, freedom to rotate with respect to the car body as is necessary to accommodate normal truck movements along both straight and curved track.

Under certain dynamic conditions, coupled with lateral track irregularities, the railcar truck also tends to adversely oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and truck. Excessive "hunting" can result in premature wear of the wheeled truck components including the wheels, bolsters, and related equipment. Hunting can also furthermore cause damage to the lading being transported in the car body.

Track speeds of rail stock, including tank/hopper cars, continue to increase. Increased rail speeds translate into corresponding increases in the amount of hunting movements of the wheeled trucks. "Gap style" or those side bearings including roller bearings simply cannot and do not limit hunting movements of the wheeled trucks. As such, the truck components including the wheels, bolsters, and related equipment tend to experience premature wear.

The art has also contemplated constant contact side bearings for railcars. Constant contact railcar side bearings not only support a railcar body with respect to the bolster during relative rotational movements therebetween but additionally serve to dissipate energy through frictional engagement between the underside of the railcar body and a bearing element thereby limiting destructive truck hunting movements. Constant contact side bearings typically include a housing assembly including a base or housing and a cap. The housing usually has a cup-like configuration and includes at least two apertured flanges, extending in opposed radial directions relative to each other, permitting the housing to be fastened to the bolster. In one form, the cap is biased from the housing and includes an upper surface for contacting and rubbing against a car body underside. The cap must be free to vertically move relative to the side bearing housing.

Such constant contact side bearings furthermore include a spring. The purpose of such spring is to absorb, dissipate, and return energy imparted thereto during a work cycle of the side bearing assembly and resiliently position the upper surface of the cap, under a preload force, into frictional contact with the car body underframe. The spring for such side bearings can comprise either spring loaded steel elements or elastomeric blocks or a combination of both operably positioned within a cavity defined by the side bearing housing and the cap. An elastomeric block which has been found particularly beneficial is marketed and sold by the Assignee of the present invention under the tradename "TecsPak." As will be appreciated, however, such an elastomeric block, by itself, lacks longitudinal stiffness and, thus, requires surrounding housing structure to provide added support and stiffness thereto.

There are several challenges presented in connection with the design of a constant contact side bearing assembly. First, and during the course of operation, clearance between sidewalls on the housing and cap of a constant contact side bearing housing assembly tend to become enlarged due to abrasion and wear. Such wear is a critical detractor to side bearing assembly performance. That is, any gap or space between the sidewalls on the housing and cap of the side bearing assembly adversely permits longitudinal or horizontal shifting movements of the cap relative to the housing thereby reducing the energy absorption capability for the side bearing assembly—a critical operating criteria for the side bearing assembly. Of course, if the gap or space between the housing and cap of the side bearing assembly reaches a critical limit, the side bearing assembly is no longer useful and can be condemned.

During operation of the railcar side bearing assembly, and while controlling the clearance or gap between the cap and housing of the side bearing assembly so as to limit horizontal shifting movements of the cap relative to the housing remains advantageous, the cap must remain able to vertically reciprocate relative to the housing. As will be appreciated, if the cap cannot vertically reciprocate during operation of the side bearing assembly, the primary purpose and function of the constant contact side bearing assembly will be lost.

Designing a side bearing assembly having a multipiece cap for controlling the gap or space between the cap and wall structure on the housing and which is biased into contact with an underside of the railcar body is also known in the art. Although beneficial in limiting the clearance or gap between the cap and housing, designing a constant contact side bearing assembly with a mulitpiece cap introduces other design problems and challenges. For example, the multipiece cap members tend to vertically separate as the railcar rolls from side-to-side. That is, after the car body rolls in a first direction, the cap members of one side bearing assembly are allowed to vertically separate relative to each other. When the railcar body again rolls in an opposite direction, the vertically separated cap members of the one side bearing assembly are vertically crushed against each other by the underside of the car body. Especially when the cap members are formed from a non-metal materials, this continuous rolling action of the car body can have an adverse affect on the cap members. Of course, any cracking or sticking of the cap members relative to the housing can and often does result in condemnation of the side bearing assembly. The ability to limit vertical separation of the cap members relative to each other, however, is complicated when considering the requirement such cap members must also maintain their ability to horizontal shift or slide relative to each other so as to limit or reduce the clearance between the cap members and outstanding wall structure on the side bearing assembly housing.

Another design challenge involved with those constant contact side bearings using an elastomeric spring relates to the buildup of heat in proximity to the elastomeric spring. During operation of the railcar, frictional contact between the railcar body and the side bearing assembly results in the development of heat buildup. Unless such heat buildup can be controlled, the elastomeric spring will tend to soften and deform, thus, adversely affecting the operable performance of the constant contact side bearing assembly.

The frictional sliding relationship between the side bearing assembly and the related railcar component can create temperatures within the side bearing assembly that can exceed the heat deflection temperature of the elastomeric spring thus causing the elastomeric spring to deform. As used herein and throughout, the term "heat deflection temperature" means and refers to a temperature level at the which the elastomeric spring, regardless of its composition, tends to soften and deform. Deformation of the elastomeric spring can significantly reduce the ability of the elastomeric spring to apply a proper preload force and, thus, decreases vertical suspension characteristics of the side bearing assembly which, in turn, results in enhanced hunting of the wheeled truck. Enhanced hunting and/or unstable cyclic yawing of the truck increases the resultant translation/oscillation of the railcar leading to a further increase in the heat buildup and further deterioration of the elastomeric spring.

Thus, there is a continuing need and desire for a railcar constant contact side bearing assembly including a multipiece cap design which allows the cap members to horizontally slide or shift relative to each other whereby optimizing energy absorption and related performance criteria for the side bearing assembly while maintaining vertical reciprocity of the cap members relative to the housing and which limits vertical separation of the cap members relative to each other

SUMMARY

According to one aspect, there is provided a constant contact side bearing assembly for a railcar including a housing and a multipiece cap arranged in operable combination with each other. The side bearing assembly housing includes upstanding wall structure defining a central axis for the side bearing assembly. The multipiece cap includes a first member arranged within the housing and having generally vertical wall structure arranged to slidably contact the wall structure of the housing arranged to one side of the central axis during operation of the side bearing assembly. The multipiece cap further includes a second member arranged at least partially within the housing and carried by the first member. The second cap member includes generally vertical wall structure arranged to slidably contact the wall structure of the side bearing housing arranged to an opposite or second side of the central axis of the side bearing assembly during operation of the side bearing assembly. A generally flat surface on the second member extends beyond the wall structure of the housing. A spring is arranged within the housing beneath both the first and second members of the multipiece cap for returning energy imparted to the spring during operation of the side bearing assembly. The members of the multipiece cap define non-vertical interengaging and slidable surfaces therebetween which are disposed at an acute angle relative to a horizontal plane for maintaining the wall structure on each cap member in sliding contact with the wall structure of the housing thereby limiting horizontal shifting movements of the multipiece cap relative to the housing while maintaining vertical reciprocity of the cap members relative to the housing. The first and second members of the multipiece cap are provided with interlocking instrumentalities for allowing the first and second cap members to horizontally slide relative to each other while limiting vertical separation of the first and second members relative to each other during operation of the side bearing assembly.

In one form, the spring of the side bearing assembly includes an elastomeric member having first and second axially aligned ends. Preferably, the generally flat surface of the second member of the multipiece cap establishes a coefficient of friction ranging between about 0.4 and about 0.9 with the railcar during operation of the side bearing assembly.

According to another aspect, there is provided a constant contact side bearing assembly for a railcar including a housing and a multipiece cap arranged in operable combination with each other. The housing includes generally vertical wall structure and defines a central axis for the side bearing assembly. The multipiece cap includes a first non-metal member arranged within the housing and a second non-metal member arranged at least partially within the housing and carried by the first member. A generally flat surface on the second non-metal. member extends beyond the wall structure on the housing. Each non-metal cap member defines wall structure. The wall structure on the first non-metal cap member is arranged to one side of the central axis for sliding contact with the wall structure of the housing during vertical reciprocatory movements of the multipiece cap relative to the housing. The wall structure on the second non-metal cap member is arranged to an opposite side of the central axis for sliding contact with the wall structure of the housing during vertical reciprocatory movements of the multipiece cap relative to the housing. A spring is arranged within the housing for returning energy imparted to the side bearing assembly. The cap members define non-vertical interengaging and slidable angled surfaces therebetween which are disposed at an acute angle relative to a horizontal plane for maintaining the wall structure on each non-metal cap member in sliding contact with the wall structure of the housing thereby limiting horizontal shifting movements of the multipiece cap relative to the housing. The first and second members of the multipiece cap carry interlocking instrumentalities for allowing the cap members to horizontally slide relative to each other while limiting vertical separation of the first and second members relative to each other during operation of the side bearing assembly.

An insert is preferably maintained in operable association with the generally flat surface on the second non-metal cap member for contacting an underside of the railcar thereby establishing a coefficient of friction ranging between about 0.4 and about 0.9 with the railcar during operation of the side bearing assembly.

According to another aspect, there is provided a constant contact side bearing assembly for a railcar including a housing, and a multipiece cap arranged in operable combination with each other. The housing includes generally vertical wall structure and defines a central axis for the side bearing assembly. The multipiece cap includes a first plastic member movably arranged within the housing and a second plastic member movably arranged at least partially within the housing and carried by the first plastic member. A portion of the second plastic member extends beyond the housing and defines generally flat surface. Each plastic cap member defines generally vertical wall structure. A spring is arranged within the housing for returning energy imparted to the side bearing assembly. The cap members define non-vertical interengaging and slidable angled surfaces therebetween which are disposed at an acute angle relative to a horizontal plane for urging and maintaining the generally vertical wall structure on each in sliding engagement with the wall structure of the housing while maintaining vertical reciprocity of both cap members relative to the housing during operation of the side bearing assembly. The first and second members of the multipiece cap are provided with interlocking instrumentalities for allowing the cap members to horizontally slide relative to each other while limiting vertical separation of the first and second members relative to each other during operation of the side bearing assembly.

To establish and maintain a coefficient of friction ranging between about 0.4 and about 0.9 with the railcar during operation of the side bearing assembly, the generally flat surface on the second plastic cap member is preferably provided with a metal insert. In one embodiment, the interlocking instrumentalities are formed as an integral part of the plastic cap members. In one form, the spring includes an elastomeric member having axially aligned ends.

According to another aspect, there is provided a constant contact side bearing assembly for a railcar including a housing, a non-metal spring seat and a non-metal top cap arranged in operable combination relative to each other. The side bearing assembly housing has generally vertical wall structure defining a central axis for the side bearing assembly. The non-metal spring seat is arranged within the housing for vertical reciprocatory movement. The non-metal top cap is at least partially arranged with the housing for vertical reciprocatory movement. The top cap has a generally flat surface spaced at least partially above the wall structure of the housing. The top cap is carried by the spring seat. A spring is arranged within the housing for returning energy imparted to the side bearing assembly. The spring seat and top cap define cooperating angled surfaces therebetween for urging the spring seat and top cap in opposed directions away from the central axis of the side bearing assembly such that non-metal wall structure, on each of the spring seat and top cap, is moved into sliding engagement with the wall structure on the housing in response to a vertical load acting on the side bearing assembly while maintaining vertical reciprocity of the spring seat and top cap relative to the housing. An apparatus is provided in operable combination with the top cap and spring seat of the multipiece cap for allowing the top cap and spring seat to horizontally slide relative to each other while limiting vertical separation of the top cap and spring seat relative to each other during operation of the side bearing assembly.

To allow the side bearing assembly to establish a coefficient of friction ranging between about 0.4 and about 0.9 with the railcar during operation of the side bearing assembly, a metallic insert is maintained in operable association with and is generally centered on the flat surface of the top cap. Preferably, the spring for the side bearing assembly includes an elastomeric member. Preferably, the apparatus for allowing the top cap and spring seat to horizontally slide relative to each other while limiting vertical separation of the top cap and spring seat relative to each other during operation of the side bearing assembly is formed integral with the top cap and spring seat.

DESCRIPTION OF THE DRAWINGS

FIG. 10 is a top plan view of a second member or top cap forming part of the present invention disclosure;

FIG. 11 is side view of the top cap illustrated in FIG. 10;

DETAILED DESCRIPTION

Figure 1:
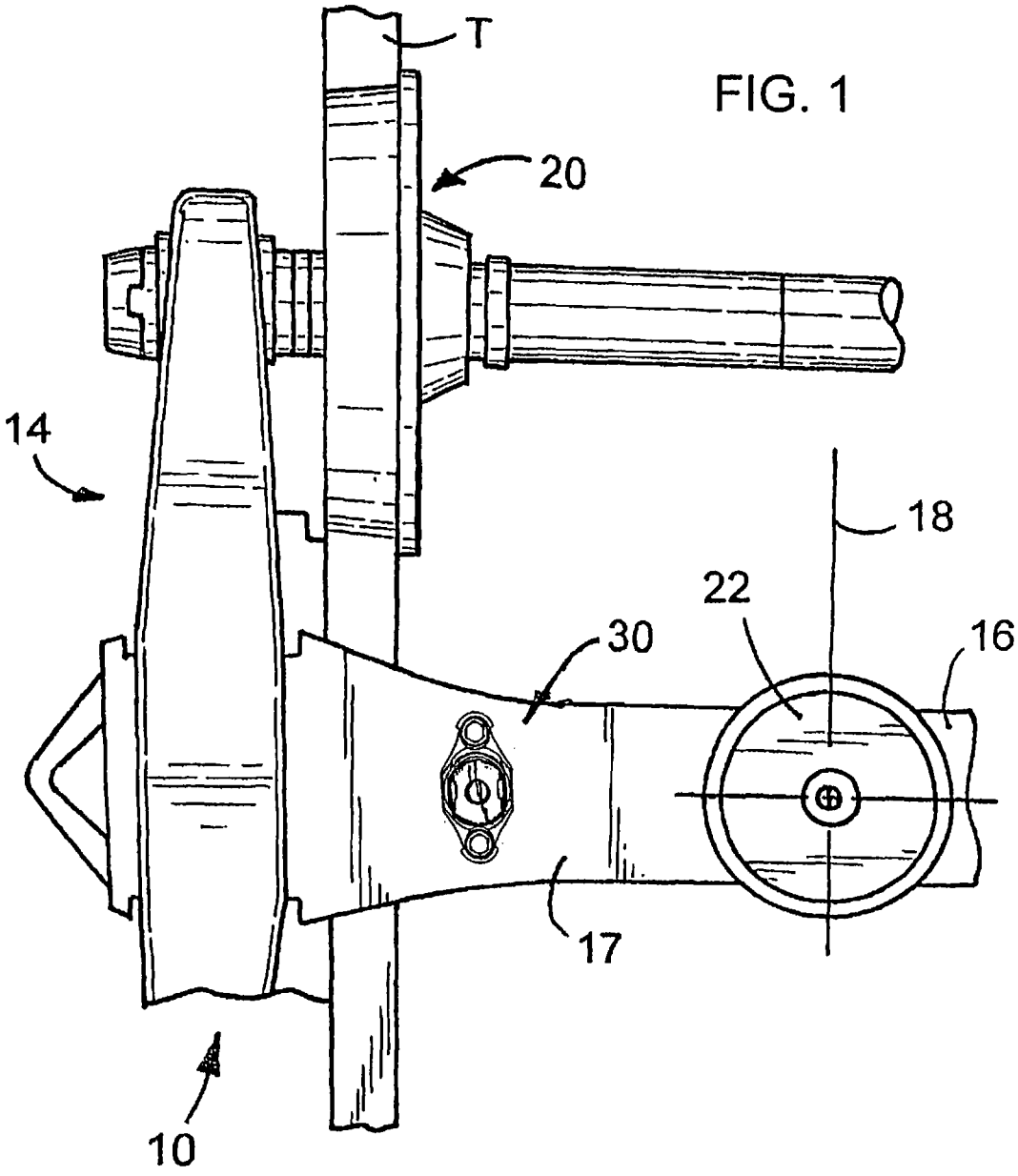
FIG. 1 is a top plan view of a portion of a railroad car wheeled truck including one form of a constant contact side bearing assembly embodying principals of this invention disclosure.

While this invention disclosure is susceptible of embodiment in multiple forms, there is shown in the drawings and will hereinafter be described a preferred embodiment of this invention disclosure, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, FIG. 1 shows a fragment of a railcar wheeled truck assembly, generally indicated by reference numeral 10, for supporting and allowing a railcar body 12 defining a part of a railcar 13 (FIG. 3) to ride along and over tracks T. Truck assembly 10 is of a conventional design and includes a side frame 14, a bolster 16, extending generally transversely relative to a longitudinal centerline 18 of the railcar body 12 (FIG. 3), and a wheel set 20. A conventional center bearing plate 22 is suitably mounted on the bolster 16 for pivotally supporting one end of the car body 12 (FIG. 3).

A railroad car side bearing assembly embodying principals of this invention disclosure is generally indicated in FIG. 1 by reference numeral 30 and is arranged in operable combination with each wheeled truck assembly 10. More specifically, and as is conventional, a railroad car side bearing assembly is mounted on an upper surface 17 of the railcar bolster 16 on opposite lateral sides of the center bearing plate 22 to limit hunting movements and oscillation of the wheeled truck assembly 10 as the railcar moves over the tracks T.

Figure 2:
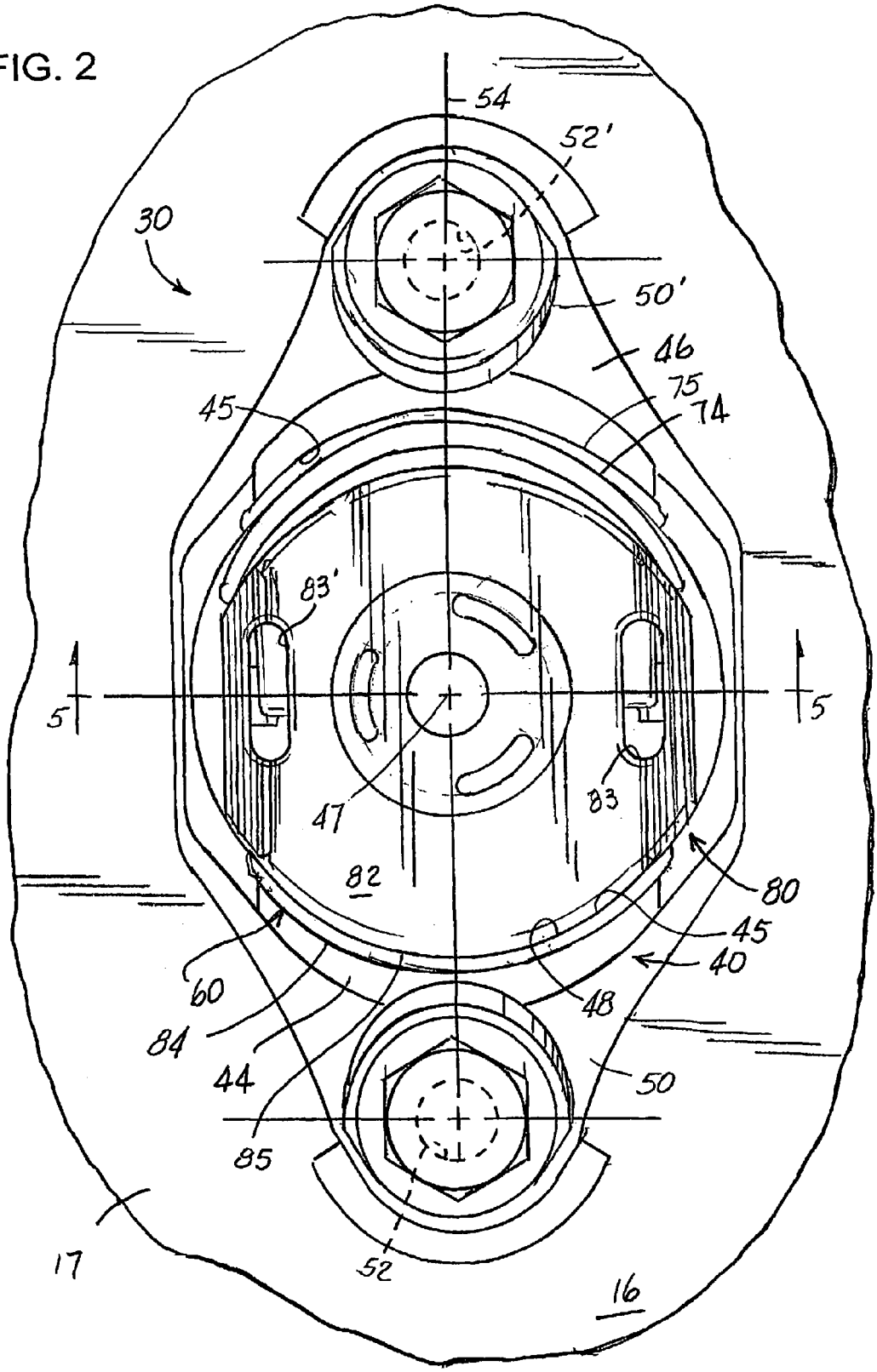
FIG. 2 is an enlarged top plan view of the constant contact side bearing assembly illustrated in FIG. 1.

The aesthetic design of assembly 30 illustrated in the drawings is merely for exemplary purposes. Whereas, the principals and teachings set forth below are equally applicable to other side bearings having different forms and shapes. Turning to FIG. 2, side bearing assembly 30 includes a housing or cage 40, a multipiece cap 60 arranged for generally telescoping or vertical reciprocatory movements relative to the housing 40, and a spring 100 (FIG. 3).

Figure 3:
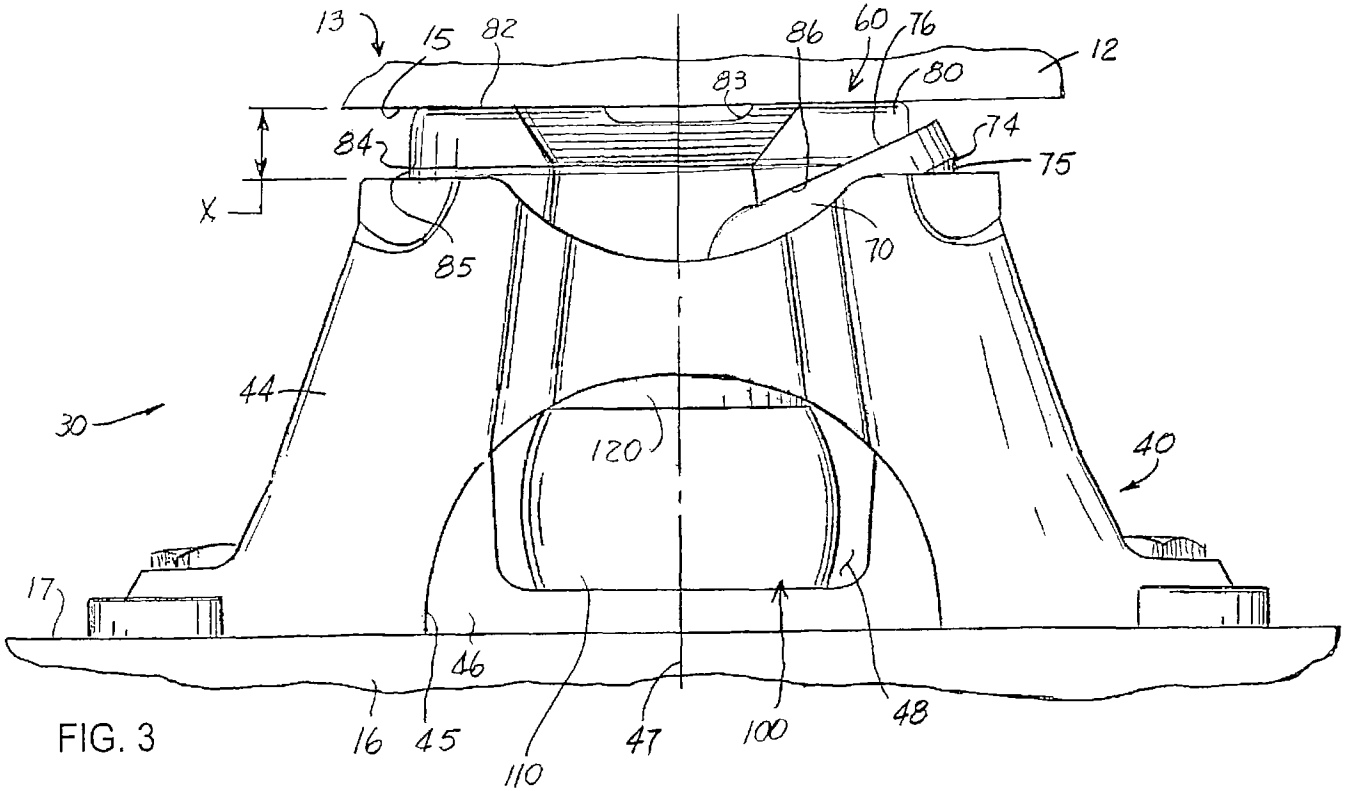
FIG. 3 is a side elevational view of the constant contact side bearing assembly illustrated in FIG. 2.
Figure 4:
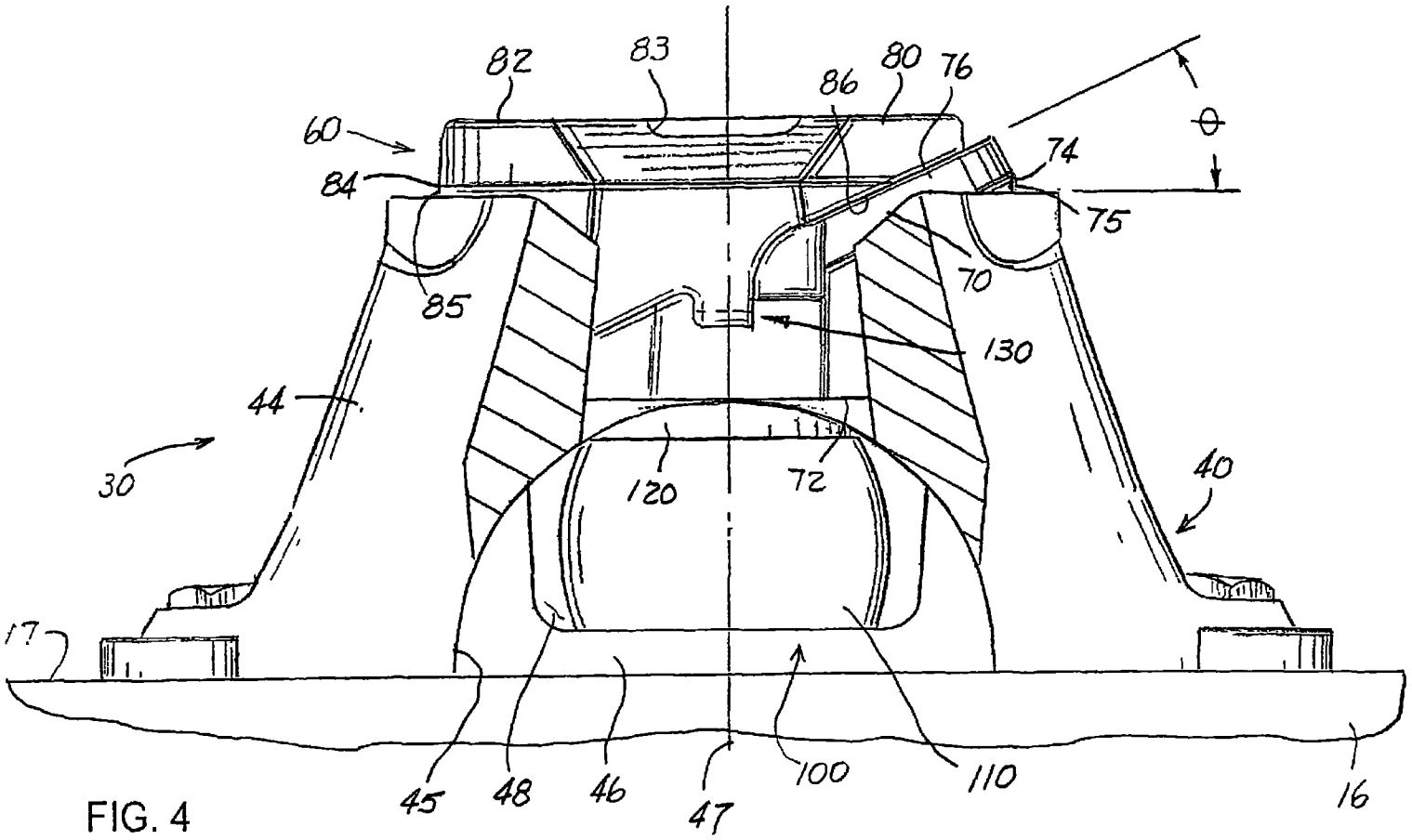
FIG. 4 is a view similar to FIG. 3 with parts broken away to show additional details.

In the embodiment shown in FIGS. 2, 3 and 4, housing 40 is preferably formed of a strong and wear resistant metal material, such as steel or the like, and includes upstanding wall structure 44 extending upwardly from a base 46 to define an axis 47 for the side bearing assembly 30. The housing wall structure 44 extends upwardly from the base 46 for a predetermined distance. The wall structure 44 of the side bearing housing 40 defines an open-top cavity or internal void 48 having a predetermined inner surface configuration.

The housing base 46 is configured for suitable attachment to an upper surface 17 of the railcar bolster 16 as through any suitable means, i.e. threaded bolts or the like. In the illustrated embodiment, housing base 46 includes a pair of mounting flanges 50 and 50' radially extending outwardly in opposed directions away from the side bearing assembly axis 47. Each mounting flange 50, 50' defines a bore or aperture 52, 52', respectively, for allowing a suitable fastener to extend therethrough so as to permit housing 40 to be fastened to the upper surface 17 of the bolster 16. Preferably, the bores or apertures 52, 52' are aligned relative to each other along a longitudinal axis 54 such that, when housing 40 is secured to the bolster 16, axis 54 extends generally parallel to the longitudinal axis 18 (FIG. 1) of car body 12.

Turning to FIG. 3, the multipiece cap 60 for assembly 30 preferably includes a first non-metal member or spring seat 70 and a second non-metal member or top cap 80 arranged in operable combination with each other. Preferably, and to enhance the vertical reciprocity of the multipiece cap 60 within housing 40, the first cap member or spring seat 70 and the second member or top cap 80 are each formed from a high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto. Besides being less weight than steel, forming the first member or spring seat 70 and the second member or top cap 80 from such non-metal, high performance plastic material has also shown lower wear rates than steel which, in turn, increases the expectant life of the side bearing assembly 30.

Figure 6:
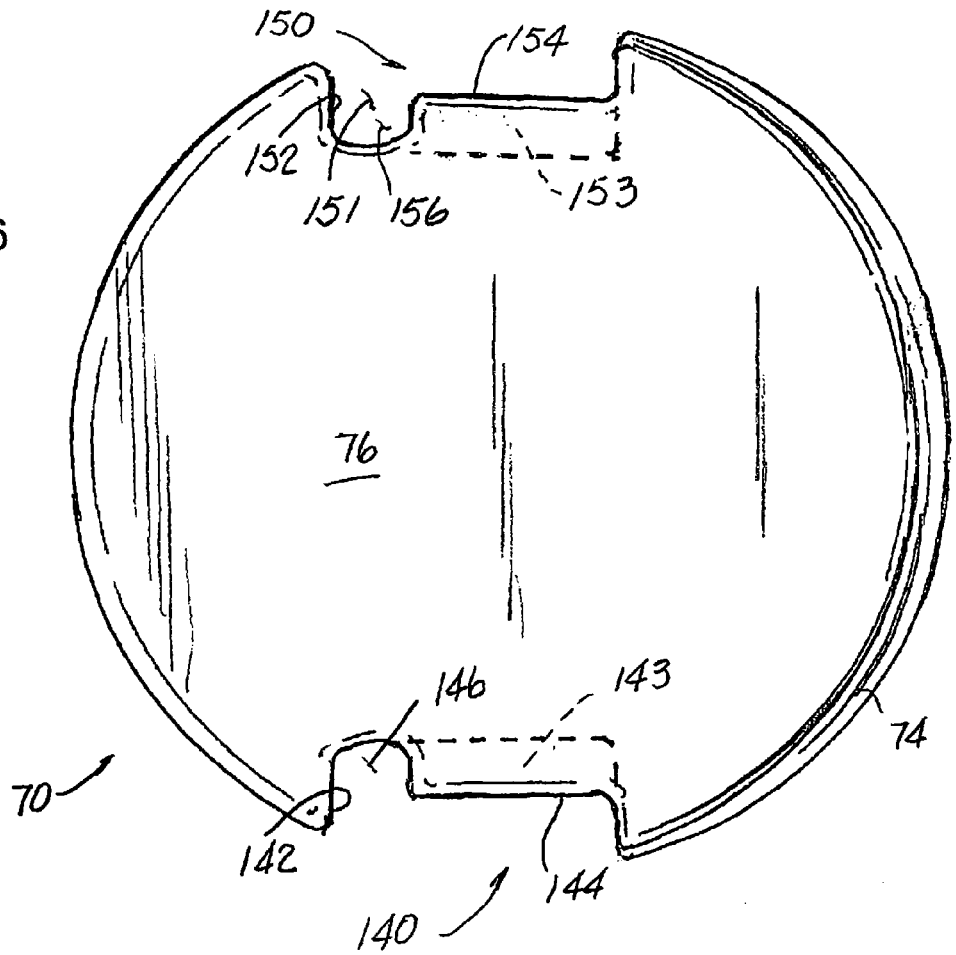
FIG. 6 is a top plan view of a first member or spring seat forming part of the present invention disclosure.
Figure 7:
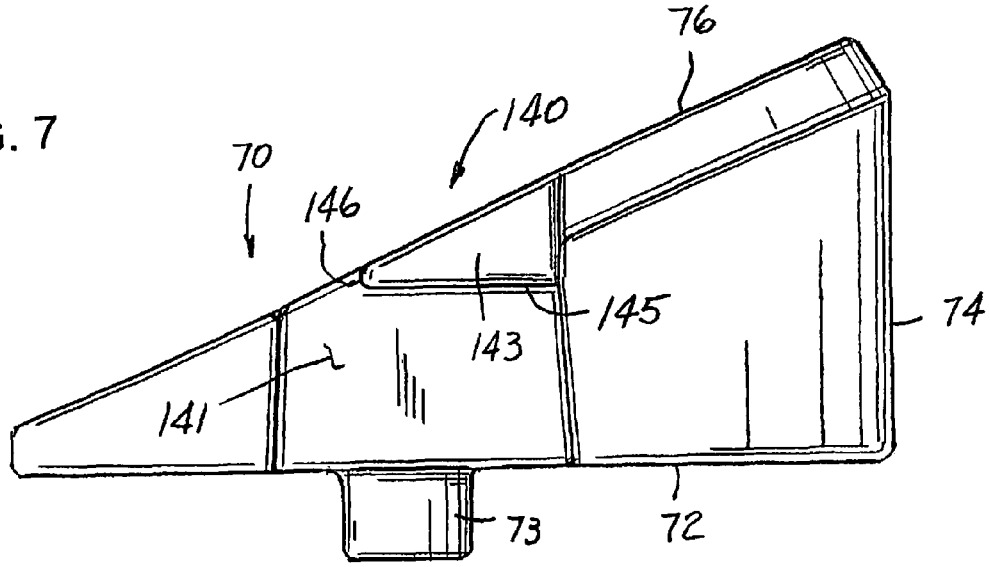
FIG. 7 is a side view of the spring seat illustrated in FIG. 6.
Figure 8:
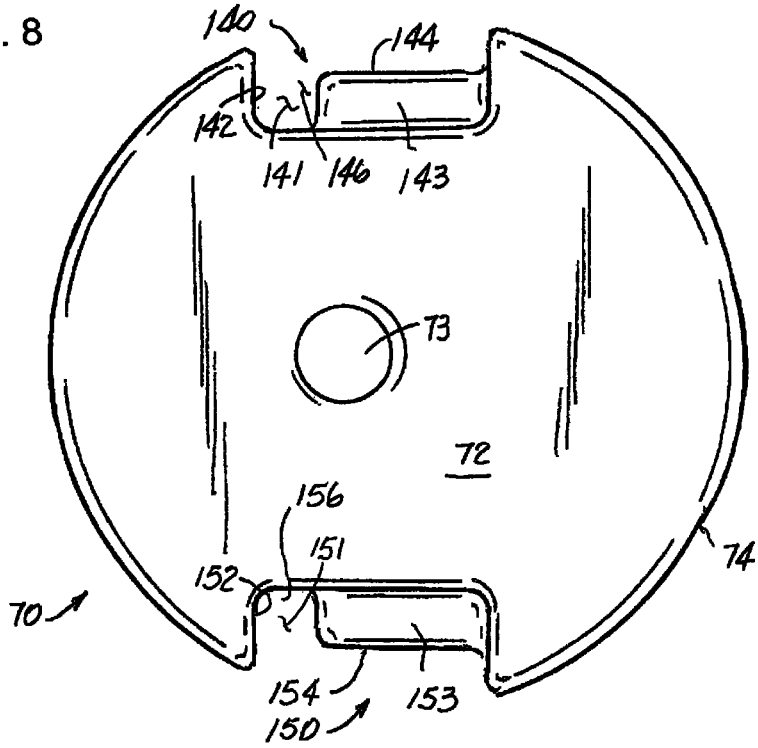
FIG. 8 is a bottom plan view of the spring seat shown in FIG. 6.
Figure 9:
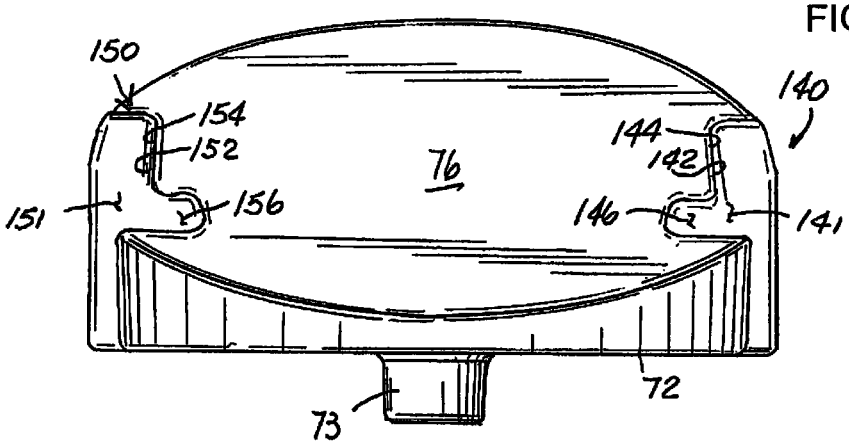
FIG. 9 is an end view of the spring seat shown in FIG. 6.

As shown in FIG. 4, spring seat 70 is positioned within the housing 40 for generally vertical movements and includes a generally horizontal or flat spring engaging surface 72. Turning to FIGS. 6 and 7, spring seat 70 furthermore includes generally vertical wall structure 74 extending upwardly from one side of surface 72. When arranged within the side bearing housing 40, the wall structure 74 of member 70 is arranged to one side of the vertical axis 47 of the side bearing assembly 30 (FIG. 2). Preferably, wall structure 74 is formed integral with the supporting plate 72. Notably, and as shown in FIG. 2, an outer surface 75 on the wall structure 74 of the spring seat 70 complements an inner surface 45 of the side bearing housing wall structure 44 arranged to one side of the vertical axis 47 of the side bearing assembly 30. In the embodiment illustrated for exemplary purposes, the side bearing housing inner surface 45 and the spring seat outer wall surface 75 each have a curved surface configuration which complement each other and promote sliding movement therebetween.

Figure 5:
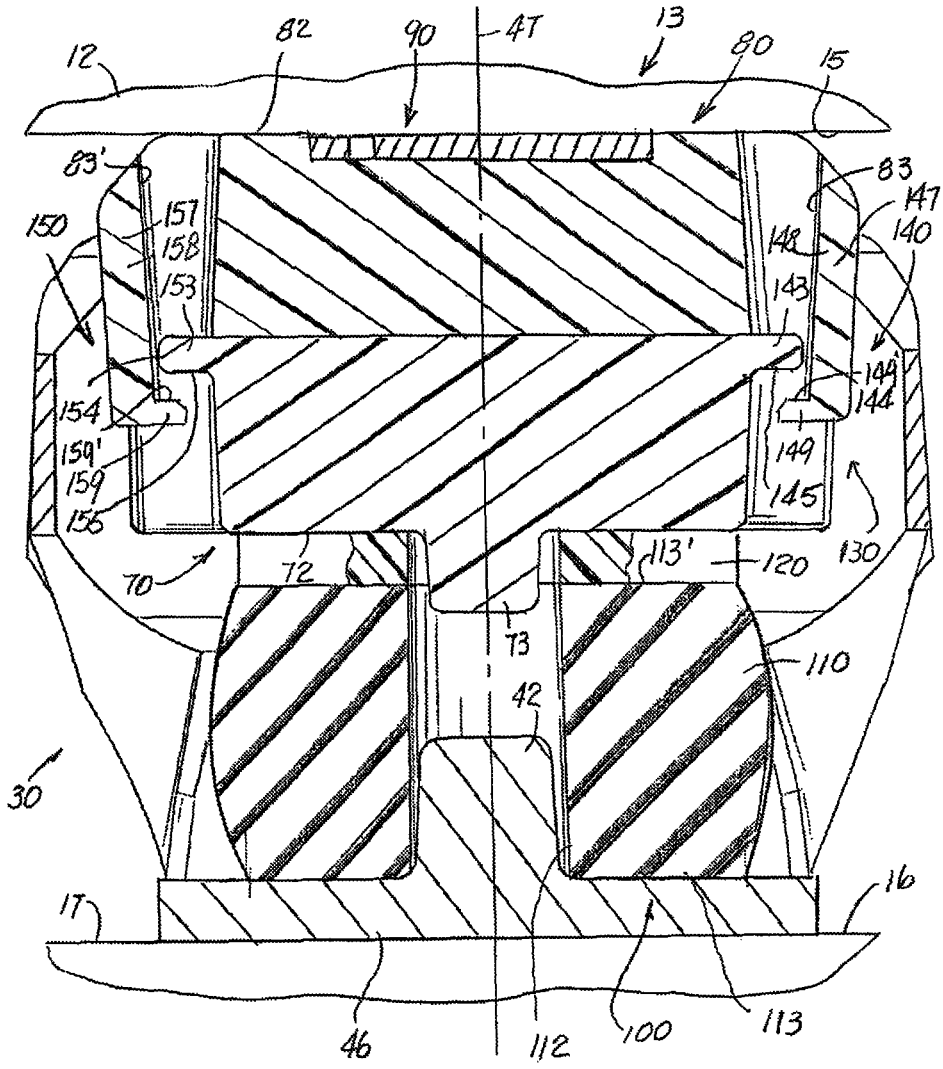
FIG. 5 is an enlarged sectional view taken along line 5-5 of FIG. 2.

As shown in FIGS. 4 and 5, the second member or top cap 80 is at least partially positioned within the housing 40 for generally vertical movements and is operably carried by the first member or spring seat 70. Turning to FIGS. 10 and 11, member 80 desirably includes an upper generally flat car engaging surface 82. As shown in FIG. 2, when the side bearing assembly 30 is secured to the bolster 16, the generally planar or flat surface 82 of member 80 is disposed above a terminal end of the upstanding wall structure 44 of the side bearing housing 40 for a predetermined distance. In the example shown in FIG. 3, the normal distance between surface 82 of member 80 and the top edge of the wall structure 44, indicated by the distance "X", is determinative of the permissible compressive movement of the side bearing assembly 30 and such that after the underside 15 of the railcar body 12 contacts the upper edge of the housing structure 44, the side bearing assembly 30 functions as a solid unit and will prevent further rocking and relative movement between the bolster 16 and the railcar body 12.

Cap member 80 furthermore includes generally vertical wall structure 84 which, when cap member 80 is assembled in operable relation with the side bearing assembly as shown in FIGS. 2, 3 and 4, is disposed to an opposite side of the axis 47 from the upstanding wall structure 74 of the spring seat 70. Preferably, the wall structure 84 is formed integral with the generally planar surface 82 of cap 80. As shown in FIG. 2, an outer surface 85 on the wall structure 84 of cap 80 complements the side bearing housing wall structure inner surface 45 disposed to an opposed side of the vertical axis 47 of the side bearing assembly 30 from surface 75 of member 70. In the embodiment illustrated for exemplary purposes, the side bearing housing inner surface 45 and the wall structure outer surface 85 on member 80 each have a curved surface configuration which complement each other and promote sliding movement therebetween.

In the embodiment shown in FIGS. 5 and 10, the top cap 80 furthermore includes an insert 90 that is maintained in operable association with and preferably generally centered on the upper generally flat surface 82 on member 80. The insert 90 is preferably formed from a metal material selected from the class of: steel and austempered ductile iron. The insert 90 is arranged in operable association with the top cap 80 so as to slidably interact and contact with the underside 15 of the car body 12 (FIG. 5). In the embodiment illustrated by way of example, the insert 90 has a diameter of about 3 inches. The exact shape and design of the insert 90 can take any of a myriad of designs and configuration without detracting or departing from the spirit and scope of this invention disclosure. Suffice it to say, the insert 90 is engineered and designed whereby allowing the side bearing assembly 30 to establish a coefficient of friction ranging between about 0.4 and about 0.9 with the railcar 12 during operation of the constant contact side bearing assembly 30 and so as to limit hunting movements and oscillation of the wheeled truck assembly 10 as the railcar moves over the tracks. Attention is directed to coassigned and copending U.S. patent application Ser. No.

13/507,145; the applicable portions of which are incorporated herein by reference for a fuller understanding the design and functionality of insert 90.

Preferably, the housing 40 and members 70, 80 comprising the multipiece cap 60 are configured relatively to each other so as to inhibit rotation of the cap members 70, 80 relative to the housing 40. In the illustrated embodiment, the inner surface 45 of the side bearing housing wall structure 44 has an oblong-like configuration which, as mentioned, complements the exterior surface configurations on the wall structures 76, 86 of the cap pieces 70 and 80, so as to inhibit rotation of the cap pieces 70, 80 relative to the housing 40. Of course, with only slight redesign, other structure, i.e, channels and projecting ribs, would equally suffice to inhibit rotation of the cap pieces 70, 80 relative to the housing 40 without detracting or departing from the spirit and scope of the present invention disclosure.

One of the salient aspects of this invention disclosure relates to the ability to limit—if not eliminate—horizontal shifting movements of the side bearing assembly cap 60 relative to the side bearing assembly housing 40 whereby significantly enhancing operating performance characteristics of assembly 30. To accomplish this desired end, and as illustrated in FIGS. 3 and 4, the first and second cap members 70 and 80, respectively, define non-vertical interengaging and slidable planar surfaces 76 and 86, respectively, therebetween for maintaining the outer surfaces 75 and 85 of the respective members 70 and 80 in frictional sliding contact with the inner surface 45 (FIG. 2) of the side bearing housing 40. That is, and in response to a vertical load being directed against assembly 30, the cooperating angled surfaces 76 and 86 on the respective first and second members 70 and 80 of the multipiece cap 60 urge the spring seat 70 and top cap 80 in opposed directions relative to each other and away from the centerline or upstanding axis 47 of the side bearing assembly 30 such that the outer surfaces 75 and 85 on each of the first and second member 70 and 80, respectively, are constantly urged toward and maintained in sliding engagement with the inner surface 45 (FIG. 2) of the side bearing housing 40.

In one form, the non-vertical surfaces 76 and 86 of the first and second members 70 and 80, respectively, of the multipiece side bearing assembly cap 60 are disposed at a predetermined acute angle θ. In one form, the predetermined acute angle θ ranges between about 20° and about 30° relative to a horizontal plane. In a most preferred form, the cooperating angled surfaces 76 and 86 between the first and second members 70 and 80, respectively, of cap 60 are disposed at an angle of about 25° relative to a horizontal plane.

Since the side bearing assembly 30 of the present disclosure is of a resilient type, it is essential some form of yieldable apparatus be incorporated therein. In this regard, spring 100 is arranged in operable combination with and for absorbing, dissipating and returning energy imparted to the multipiece cap 60. As shown, spring 100 is arranged and accommodated within a chamber or cavity 48 formed by a combination of housing 40 and cap 60 for urging the multipiece cap 60 upwardly into contact with the underside 15 of the railcar body 12 (FIG. 3).

Like the overall side bearing design, the exact shape or form of the spring 100 can vary or be different from that illustrated for exemplary purposes without detracting or departing from either the spirit or scope of this invention disclosure. In the embodiment illustrated in FIGS. 3, 4 and 5, spring 100 is comprised of a formed and resiliently deformable thermoplastic elastomer member 110 and, preferably, a thermal insulator 120.

In the embodiment illustrated for exemplary purposes in FIGS. 4 and 5, member 110 of spring 100 has a configuration suitable for accommodation between base 46 of the side bearing housing 40 and an underside of the support plate 72 of the spring seat 70. Member 110, illustrated by way of example in FIG. 4, preferably embodies the teachings set forth in coassigned U.S. Pat. No. 7,338,034; the applicable portions of which are incorporated herein by reference. In the illustrated embodiment, member 110 defines a generally centralized bore 112 opening to axially aligned ends 113, 113' of member 110. It should be appreciated, however, member 110 could also be solidly configured. Suffice it to say, the thermoplastic member 110 preferably has an elastic strain to plastic strain ratio of about 1.5 to 1. Coassigned U.S. Pat. No. 4,198,037 to D. G. Anderson, the applicable portions of which are incorporated hereby by reference, better describes the composition and methodology for forming member 110.

The thermal insulator 120 of spring 100 is preferably arranged at one end of and is intended to operably protect the thermoplastic member 110 from the adverse affects of heat generated by the sliding frictional movements between the underside 15 of the railcar body 12 (FIG. 3) and the planar surface 82 on the side bearing cap 60 during movements of the railcar between locations. Suffice it to say, and in the illustrated embodiment, the thermal insulator 120 is operably carried at one end of the thermoplastic member 110 and is preferably of the type disclosed in coassigned U.S. Pat. Nos. 6,092,470; 6,892,999; and 7,044,061; the applicable portions of which are incorporated herein by reference.

In the embodiment illustrated for exemplary purposes in FIGS. 3 and 4, the base 46 of the side bearing assembly 40 supports that end of the spring 100 opposite from the thermal insulator 120. Preferably, a spring guide or projection 42 (FIG. 5) is provided and is centrally located on the base 46 of the side bearing housing 40. In the embodiment illustrated in FIG. 5, the spring guide 42 fits within the bore or recess 112 defined by member 110 whereby operably locating at least the lower end of the spring 100 within the side bearing assembly housing 40. Preferably, a spring guide 73 depends from the underside 72 of cap member and fits through the thermal insulator 120 and into the bore or recess 112 (FIG. 5) defined by member 110 whereby operably locating the upper end of the spring 100 within the side bearing assembly housing 40.

In the embodiment illustrated for exemplary purposes, the side bearing assembly 30 is configured to promote the dissipation of heat from the cavity 48 and away from the thermoplastic spring 100 thereby prolonging the usefulness of the side bearing assembly 30. As shown in FIGS. 3 and 4, the wall structure 44 of the side bearing housing 40 preferably defines a pair of openings 45 (with only one being shown) disposed to opposite lateral sides of the longitudinal axis 47 of the side bearing housing 40 and extending through a thickness of the wall structure 44. Each opening 45 is formed toward the base 46 or toward a lower end of the side bearing housing 40 in a vicinity of an intersection between wall structure 44 and base 46. In the illustrated embodiment, the openings 45 are generally aligned along a line extending generally perpendicular or normal to axis 54 of housing 40. As will be appreciated, the openings 45 provide a particular advantage when a thermoplastic spring is used to resiliently urge the cap 60 against and into frictional sliding contact with an underside 15 of the railcar body 12 (FIG. 2) by allowing air to freely pass through the housing 40 and away from the spring 100.

The multipiece cap 60 of the side bearing assembly 30 is furthermore preferably designed to reduce the adverse affects of heat on the thermoplastic spring 100 during operation of the side bearing assembly 30. More specifically, in the embodiment illustrated in FIGS. 2, 5 and 10, the top cap or member 80 of the multipiece cap 60 includes a pair of diametrically opposed openings 83, 83' arranged toward an intersection of the generally flat surface 82 and the wall structure 84 on member 80. Preferably, the openings 83, 83' are disposed such that they are not completely blocked when the generally flat surface 82 on cap member 80 is frictionally engages with the underside 15 of the railcar body (FIG. 2). Although two openings in the top cap 80 are illustrated for exemplary purposes, more openings can be provided and their disposition relative to the wall structure 84 altered without detracting or departing from the spirit and scope of this invention disclosure. Suffice it to say, the purpose of the openings 83, 83' is to direct heat away from the spring 100 thereby prolonging the usefulness of the spring and the effectiveness of the side bearing assembly. Any suitable structure for accomplishing those desirable ends would should be considered within the spirit and scope of this aspect of the invention disclosure.

An apparatus 130 is carried by the first member or spring seat 70 and the top cap 80 for allowing the spring seat 70 and top cap 80 to horizontally slide relative to each other while limiting vertical separation of the spring seat 70 and said top cap 80 relative to each other during operation of said constant contact side bearing assembly 30. In the embodiment illustrated in FIG. 5, the first and second members 70 and 80, respectively, of the multipiece cap 60 are provided with interlocking instrumentalities 140 and 150 for allowing the first and second cap members 70 and 80, respectively, to horizontally slide relative to each other so as to maintain the wall structure 74 and 84 of the first and second cap members 70 and 80, respectively, in frictional sliding contact with the interior wall structure 45 of housing 40 (FIG. 3) while limiting vertical separation of the first and second members 70 and 80, respectively, relative to each other during operation of the constant contact side bearing assembly 30. The interlocking instrumentalities 140 and 150 for accomplishing such ends can take a myriad of configuration and designs without detracting or departing from the spirit and novel scope of this invention disclosure.

In the embodiment illustrated by way of example in FIG. 5, the instrumentalities 140 and 150 comprising apparatus 130 are preferably disposed in diametrically opposed relation relative to each other and on opposed lateral sides of the axis 47 of the side bearing assembly 30. As may be deduced from FIGS. 5, 6, 8, 9, 10 12, components of the instrumentalities 140 and 150 are preferably disposed toward an outer side edge and radially inwardly of a generally arcuate segment defined by the outer surfaces 74 and 84 of pieces 70 and 80 of cap 60.

In one form, the interlocking instrumentalities 140 and 150 are mirror images of each other. As shown by way of example in FIG. 6, and toward opposed lateral exterior sides thereof, the first cap member or spring seat 70 defines a pair of open-sided recesses or voids, generally indicated by reference numerals 141 and 151. Each recess or void 141, 151 defined by cap member 70 has a predetermined marginal edge 142, 152, respectively. Moreover, and toward opposed sides thereof, the first cap member 70 defines a pair of steps or supports 143, 153 laterally projecting in opposed directions relative to each other and away from the center of cap member 70. Each step or support 143, 153 preferably has a generally linear side edge 144, 154, respectively, extending generally parallel relative to each other. Moreover, and as shown in FIGS. 5 and 7, each step or support 143, 153 also has a generally flat or planar underside or undersurface 145, 155, respectively, extending generally parallel to surface 17 on the bolster 16 (FIG. 1) and which opens to the generally flat spring engaging surface 72 of cap member 70.

Preferably, each step or support 143, 153 extends for a predetermined portion of the longitudinal length of the respective opening 141, 151. As such, an entry port 146, 156 extends between and opens to both the slanted planar surface 76 of cap member 70 and to the underside or surface 145, 155 of the each projection 143, 153 longitudinally between a distal end of each lateral step or support 143, 153 and the marginal edge of the opening 142, 152, respectively. In one form, each entry port 145, 155 has a predetermined width defined between a distal end of each lateral step or support 143, 153 and the marginal edge of the respective opening 142, 152.

Figure 12:
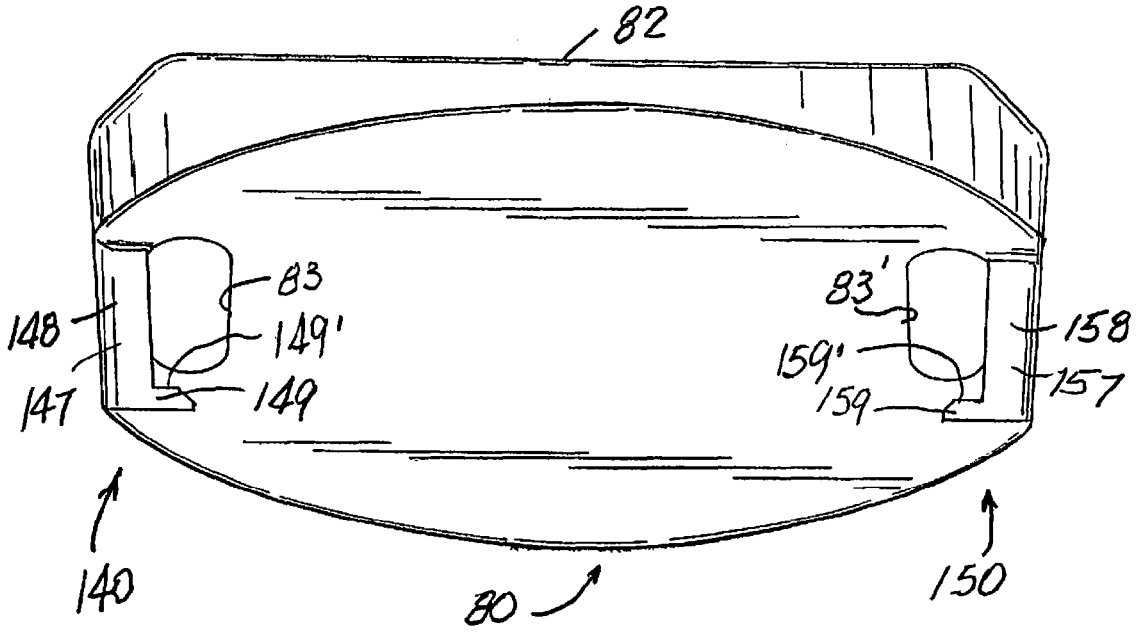
FIG. 12 is an end view of the top cap illustrated in FIG. 10.

As shown by way of example in FIGS. 5, 11, and 12, and toward opposed exterior sides thereof, the second member or top cap 80 carries a pair of depending arms, generally indicated by reference numerals 147 and 157 which are adapted to operably cooperate with the steps or supports 143, 153 on the first cap member or spring seat 70. As shown in FIGS. 5 and 12, each arm 147, 157 includes a vertically depending arm section 148, 158, respectively, along with a generally horizontal arm section 149, 159, respectively, extending generally normal or perpendicular to the vertically depending arm section 148, 158, respectively, and inwardly toward the center of cap member 80. Notably, in a preferred embodiment, the arm sections 148, 158 on cap member 80 embrace and capture the projections 143, 153 on cap member 70 therebetween. Each generally horizontal arm section 149, 159 defines a generally flat or planar surface 149', 159', respectively, extending generally parallel to and, when the pieces 70, 80 of the multipiece cap 60 are arranged in operable combination with each other, in confronting relation with the generally flat or planar underside or undersurface 145, 155, respectively, on cap member 70. As such, the interlocking instrumentalities 140 and 150 comprising apparatus 130 readily allow the spring seat 70 and top cap 80 to horizontally slide relative to each other while limiting vertical separation of the spring seat 70 and said top cap 80 relative to each other during operation of said constant contact side bearing assembly 30.

In one form, the generally horizontal arm section 149, 159 of each arm 147, 157, respectively, has a predetermined width and preferably extends the full width of the vertically depending arm section 148, 158, respectively. Moreover, and in a preferred form, the predetermined width of the generally horizontal arm section 148, 158 is greater than the size of the respective entry port 146, 156 on the second cap member or spring seat 70. As such, and during assembly of the multipiece cap 60, the cap pieces 70 and 80 need be angled or tilted relative to each other to allow the generally horizontal arm section 149, 159 on the respective arm 147, 157 to fit within and through the respective entry port 146, 156 on the first cap member or spring seat 70 whereby allowing the generally horizontal arm section 149, 159 of each arm 147, 157 to fit under and into confronting relation relative to the respective generally flat or planar underside or undersurface 145, 155 on cap member 70. As will be appreciated from an understanding of this disclosure, this design furthermore inhibits the cap pieces 70 and 80 from inadvertently becoming completely separated from each other during operation of the railcar constant contact side bearing assembly 30 regardless of the horizontal sliding position of the cap pieces 70 and 80 relative to each other.

Figure 13:
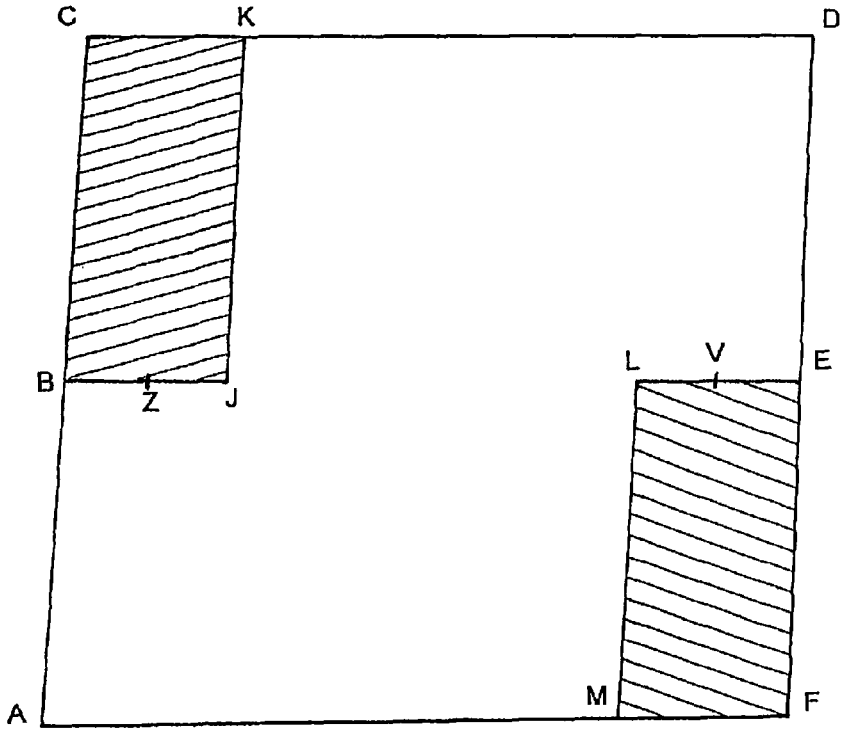
FIG. 13 is a graph showing the enhanced vertical energy capability offered by a side bearing assembly according to the invention disclosure and a prior art type constant contact side bearing assembly.

The advantages provided by a side bearing assembly embodying principals of this invention disclosure are illustrated by way of example in FIG. 13 which schematically illustrates a calculated longitudinal force-displacement hysteresis loop of the present disclosure wherein the outer parallelogram defined by points ABCDEFA represents a cycle length of a side bearing assembly embodying principals of the present disclosure as the bolster 16 of truck assembly 10 oscillates or "hunts" between extreme positions of travel about the center bearing plate 22 (FIG. 1). It should be noted, however, the schematic illustration in FIG. 13 is intended for illustrative purposes only and should not be interpreted or construed, directly or indirectly, as representing actual measurements of loads applied to or movements associated with components parts of the side bearing assembly 30.

The area of the graph shown in FIG. 13 and defined by points ABZJKDEVLMA illustrates a calculated force-displacement hysteresis loop of a conventional side bearing assembly wherein a gap or space is required between the top cap and side bearing housing to allow for vertical displacement of the cap relative to the side bearing housing. More specifically, in the graph shown in FIG. 13, points ABZJKDEVLMA represent a cycle length of a conventional side bearing assembly having a gap or space between the side bearing housing and cap and the effects on longitudinal loading of the side bearing assembly caused by such space or gap between the side bearing housing and cap as the truck assembly bolster 16 oscillates or "hunts" between extreme positions of travel about the center bearing plate 22 (FIG. 1).

Point A on the graph illustrated in FIG. 13 schematically represents the increased longitudinal loading on the side bearing assembly when the truck assembly bolster 16 (FIG. 1) is urged toward an extreme rotational position and the sidewalls of a conventional side bearing assembly are pressed into contact relative to each other by the longitudinal loads placed on the side bearing assembly as a result of the truck assembly "hunting" or yawing between positions as the railcar moves between locations. The distance between points A and B in FIG. 13 schematically represents the reduced longitudinal loading on the side bearing assembly as the truck assembly bolster 16 traverses in a first rotational direction away from one extreme rotational position.

Point B on the graph illustrated in FIG. 13 schematically represents the longitudinal loading on the side bearing when the railcar bolster is arranged toward a position, proximate to its extreme rotational position, but wherein the sidewalls of the side bearing housing and cap of the side bearing assembly have deflected as a result of the reduced longitudinal loads being removed therefrom. Points B and Z on the graph in FIG. 13 schematically illustrate the relatively constant longitudinal loading on the side bearing assembly as the truck assembly bolster 16 moves away from a position, proximate to its extreme rotational position, wherein longitudinal loads are lessened on and deflection has occurred to the sidewalls of the side bearing housing and cap, to a neutral or centered position. The relatively constant longitudinal loading of the railcar side bearing assembly remains as the cap longitudinally shifts in the gap between it and the side bearing housing is represented by the distance between points B and Z.

As shown in FIG. 13, between points Z and J, the longitudinal loading on the side bearing assembly loading remains relatively constant as the gap between the cap and side bearing assembly continues to collapse as the truck assembly bolster 16 continues to rotate about the center bearing plate 22 (FIG. 1) from the neutral position toward an opposite extreme rotational position. Point J on the graph shown in FIG. 13 represents the longitudinal loading on the side bearing assembly when the sidewalls of the side bearing housing and cap of a conventional side bearing assembly again contact relative to each other. The distance between points J and K on the graph shown in FIG. 13 schematically represents the increase in longitudinal loading on the side bearing assembly as the sidewalls of the side bearing housing and cap of a conventional side bearing assembly deflect as the bolster 16 continues to rotate or move toward the extreme rotational position during hunting movements of the truck assembly 10.

With the sidewalls of the side bearing housing and cap of a conventional side bearing assembly in contact relative to each other (point K), the longitudinal loading on the side bearing assembly remains relatively constant as indicated on the graph illustrated in FIG. 13 between points K and D. Between points K and D on the graph illustrated in FIG. 13, the railcar underside 15 slides relative to the side bearing assembly as the bolster continues to traverse toward an extreme rotational position.

Point D on the graph illustrated in FIG. 13 schematically represents the increased longitudinal loading on the side bearing assembly when the truck assembly bolster 16 (FIG. 1) is urged toward an extreme rotational position (opposite from the position represented in the graph shown in FIG. 13 by point A and the sidewalls of the side bearing assembly are pressed into contact relative to each other by the increased longitudinal loads placed on the side bearing assembly as a result of the truck assembly "hunting" or yawing between positions as the railcar moves between locations. Between points D and E on the graph illustrated in FIG. 13, the longitudinal loading on the side bearing assembly is again reduced as a result of the truck assembly bolster 16 traversing in a second rotational direction away from one extreme rotational position toward a position arranged proximate the extreme rotational position but wherein deflection of the sidewalls of the side bearing housing and cap have occurred as a result of the longitudinal loads being removed therefrom. Points E and V on the graph in FIG. 13 schematically illustrate the relatively constant longitudinal loading on the side bearing assembly as the truck assembly bolster 16 moves away from a position, proximate to its extreme rotational position, wherein longitudinal loads are removed from the sidewalls of the side bearing housing as the cap moves to a neutral or centered position. The relatively constant longitudinal loading of the railcar side bearing assembly remains as the cap longitudinally shifts in the gap between it and the side bearing housing is represented by the distance between points E and V.

As shown in FIG. 13, and between points V and L, the longitudinal loading on the side bearing assembly remains relatively constant as the gap between the cap and side bearing housing continues to collapse as the truck assembly bolster 16 continues to rotate about the center bearing plate 22 (FIG. 1) from the neutral position toward an opposite extreme rotational position and through a position (point L) wherein the sidewalls of the side bearing housing and cap of a conventional side bearing again come in contact relative to each other. The distance between points L and M on the graph shown in FIG. 13 schematically represents the increase in longitudinal loading on side bearing assembly as the sidewalls of the side bearing housing and cap, of a conventional side bearing assembly deflect as the bolster 16 continues to rotate or move toward the extreme rotational position during hunting, movements of the truck assembly 10.

With the sidewalk of the side bearing housing and cap of a conventional side bearing assembly being in contact relative to each other (point M), the longitudinal loading on the side bearing assembly remains relatively constant as indicated on the graph illustrated in FIG. 13 between points M and A. Between points M and A on the graph illustrated in FIG. 13, the railcar underside 15 slides relative to the side bearing assembly as the bolster continues to traverse toward an extreme rotational position.

The adverse affects of the spacing between the top cap and housing of a conventional side bearing assembly are illustrated in FIG. 13 by the distance between points B and J along with the distance between points E and L. That is, as the truck assembly bolster 16 rotates during "hunting" movements thereof, the rotational movement of the truck assembly bolster 16 places a force or longitudinal load on the side bearing assembly whereby causing the top cap of the side bearing assembly to longitudinally shift relative, to the side bearing housing until the distance separating the wall structure of the top cap and the wall structure of the side bearing housing collapses. The collapse of the distance separating the wall of the top cap from the wall of the side bearing housing is schematically represented in FIG. 13 by the distance between points B and J along with E and L. It is important to note, the distance separating the wall of the top cap from the wall of the side bearing housing on a conventional side bearing assembly progressively worsens with wear. That is, the distance separating the wall of the top cap from the wall of the side bearing housing, schematically represented in FIG. 13 by the distance between points B and J along with E and L, continues to increase with wear. Increased wear between the cap and side bearing housing reduces the energy absorption capability of the side bearing assembly.

Notably, the side bearing assembly of the present disclosure is furthermore designed to be self-adjusting. That is, during operation of the side bearing assembly embodying features of the present disclosure, the interengaging and sliding surfaces on the side bearing housing and the multipiece top cap automatically adjust to wear therebetween and, thus, are maintained in constant contact relative to each other. Accordingly, and with the present disclosure, there is substantially no lost motion between the top cap and side bearing housing when the truck assembly 10 shifts from one rotational position to the other. Accordingly, and as schematically represented in FIG. 13 those shaded areas marked with diagonal lines in the graph shown in FIG. 13 are advantageously available for energy absorption by the side bearing assembly 30 during operation of the constant contact side bearing assembly. As noted above, those shaded areas marked with diagonal lines in the graph shown in FIG. 13 schematically illustrating the enhanced ability of the side bearing assembly of the present disclosure to absorb energy will only increase when considering wear between the cap and side bearing housing of a conventional side bearing assembly.

Figure 14:
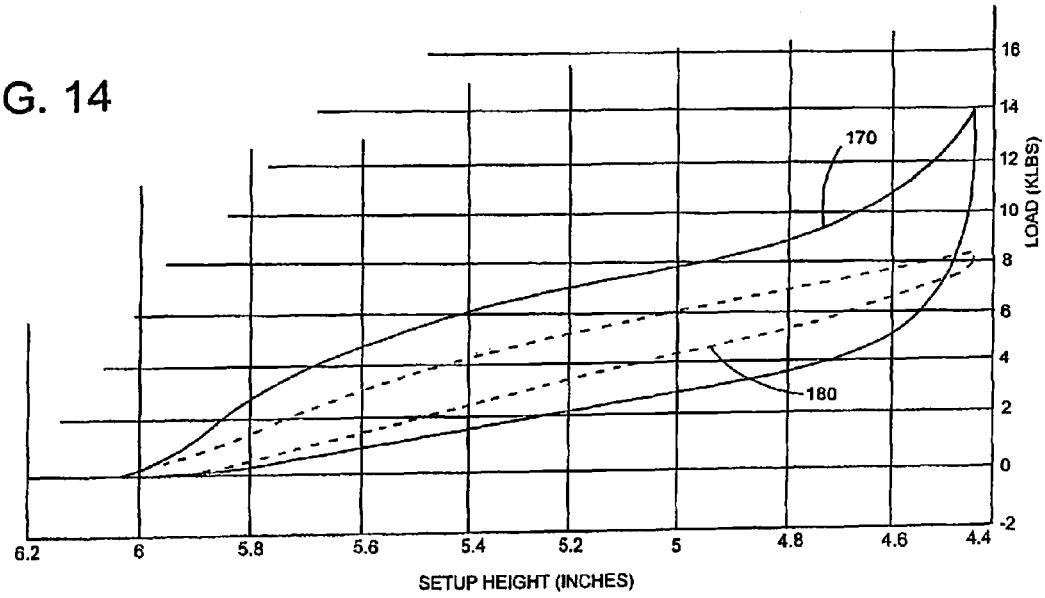
FIG. 14 is a graph representative of a force-displacement plot of hysteresis loops of both a prior art type constant contact side bearing assembly and an embodiment of a constant contact side bearing assembly according to this invention disclosure.

The advantages of a side bearing assembly embodying principals and teachings of the present disclosure are further exemplified in FIG. 14. The solid line or hysteresis loop 170 in the graph illustrated in FIG. 14 represents the vertical energy absorption capabilities of the side bearing assembly embodying principals and teachings of the present invention disclosure. The dash line or hysteresis loop 180 in the graph illustrated in FIG. 14 represents the vertical energy absorption capabilities of a conventional side bearing assembly. The enhanced ability of the side bearing assembly embodying principals of this invention disclosure to absorb, dissipate and return energy to the railcar as compared to a conventional side bearing design is readily apparent when the two hysteresis loops 170 and 180 are compared.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A constant contact side bearing assembly for a railcar, comprising:

a housing including upstanding wall structure defining a central axis for said side bearing assembly;

a multipiece cap arranged in operable combination with said housing and including a first member arranged within said housing and having wall structure arranged to frictionally contact the wall structure of said housing during vertical movements of said first member, with the wall structure of said first member being arranged to one side of the central axis of said side bearing assembly, a second member arranged within said housing and carried by said first member, said second member including wall structure arranged to frictionally contact said wall structure of said housing during vertical movements of said second member, with the wall structure of said second member being arranged to a second side of the central axis of said side bearing assembly, and wherein a portion of said second member extends beyond the wall structure of said housing and defines a friction surface for said cap, with said friction surface being urged into constant engagement with a related part on said railcar;

a spring arranged within said housing for urging the friction surface on said cap into frictional contact with said related part on said railcar;

wherein said first and second members of said multipiece cap define non-vertical interengaging and slidable surfaces therebetween disposed at an acute angle relative to a horizontal plane for maintaining the wall structure on each cap members in frictional sliding contact with the wall structure of said housing thereby limiting horizontal shifting movements of said friction surface relative to said housing while maintaining vertical reciprocity of said cap relative to said housing during operation of said side bearing assembly; and wherein said first and second members of said multipiece cap are provided with interlocking instrumentalities for allowing said first and second cap members to horizontally slide relative to each other so as to maintain the wall structure of the first and second cap members in frictional sliding contact with the wall structure of said housing while limiting vertical separation of said first and second members relative to each other during operation of said constant contact side bearing assembly.

2. The constant contact side bearing assembly according to claim 1 wherein, said housing and at least one member of said multipiece cap define cooperating instrumentalities for guiding said members for vertical reciprocatory movements relative to said housing and for maintaining a predetermined relation between said members and said housing.

3. The constant contact side bearing assembly according to claim 1 wherein, said spring includes an elastomeric member having first and second axially aligned ends.

4. The constant contact side bearing assembly according to claim 1 wherein, the generally flat surface of the second member of the multipiece cap establishes a coefficient of friction ranging between about 0.4 and about 0.9 with the railcar during operation of the side bearing assembly.

5. The constant contact side bearing assembly according to claim 1 wherein, the interlocking instrumentalities on said first and second cap members are formed integral with said first and second members.

6. A constant contact side bearing assembly for a railcar, comprising:

a housing including upstanding wall structure defining a central axis for said side bearing assembly;

a multipiece cap arranged in operable combination with said housing and including a first non-metal member arranged for vertical reciprocatory movement within said housing, with said first non-metal member having wall structure arranged to slidably contact the wall structure of said housing during vertical reciprocatory movements of said first member, and with the wall structure of said first member being arranged to one side of the central axis of said side bearing assembly, a second non-metal member arranged within said housing and carried by said first member, with said second non-metal member including wall structure arranged to slidably contact said wall structure of said housing during vertical reciprocatory movements of said second member, and with the wall structure of said second member being arranged to a second side of the central axis of said side bearing assembly, and wherein a generally flat surface on said second non-metal member extends beyond the wall structure of said housing;

a spring arranged within said housing beneath said first and second members of said multipiece cap for returning energy imparted to said spring during operation of said side bearing assembly;

wherein said first and second members of said multipiece cap define non-vertical interengaging and slidable surfaces therebetween and disposed at an acute angle relative to a horizontal plane for maintaining the wall structure on each of said non-metal members in sliding contact with the wall structure of said housing thereby limiting horizontal shifting movements of said multipiece cap relative to said housing; and wherein said first and second members of said multipiece cap carry interlocking instrumentalities for allowing said first and second members to horizontally slide relative to each other while limiting vertical separation of said first and second members relative to each other during operation of said constant contact side bearing assembly.

7. The constant contact side bearing assembly according to claim 6 wherein, said housing and at least one member of said multipiece cap define cooperating instrumentalities for guiding said members for vertical reciprocatory movements relative to said housing and for maintaining a predetermined relation between said members and said housing.

8. The constant contact side bearing assembly according to claim 6 wherein, said spring includes an elastomeric member having first and second axially aligned ends.

9. The constant contact side bearing assembly according to claim 6 wherein, the generally flat surface of the second non-metal cap member carries a metallic insert for establishing a coefficient of friction ranging between about 0.4 and about 0.9 with the railcar during operation of the side bearing assembly.

10. A constant contact side bearing assembly for a railcar, comprising:

a housing including generally vertical wall structure defining a central axis for said side bearing assembly;

a multipiece cap arranged in operable combination with said housing, said cap including a first plastic member movably arranged within said housing, a second plastic member movably arranged at least partially within said housing and slidably carried by first plastic member, with a portion of said second plastic member extending beyond said housing and defining a generally flat surface;

a spring arranged within said housing for returning energy imparted to said side bearing assembly; and wherein said plastic cap members define cooperating angled surfaces therebetween and disposed at an acute angle relative to a horizontal plane for urging and maintaining generally vertical wall structure on said first plastic member and generally vertical wall structure on said second plastic member into sliding engagement with the generally vertical wall structure on said housing while maintaining vertical reciprocity of both cap members relative to said housing during operation of said side bearing assembly; and wherein said first and second plastic cap members of said multipiece cap carry interlocking instrumentalities for allowing said first and second members to horizontally slide relative to each other while limiting vertical separation of said first and second members relative to each other during operation of said constant contact side bearing assembly.

11. The constant contact side bearing assembly according to claim 10 wherein, said housing and at least one member of said multipiece cap define cooperating instrumentalities for guiding said members for vertical reciprocatory movements relative to said housing and for maintaining a predetermined relation between said members and said housing.

12. The constant contact side bearing assembly according to claim 10 wherein, said spring includes an elastomeric member having first and second axially aligned ends.

13. The constant contact side bearing assembly according to claim 10 wherein, the interlocking instrumentalities for allowing said first and second members to horizontally slide relative to each other while limiting vertical separation of said first and second members relative to each other during operation of said constant contact side bearing assembly are formed integral with said first and second members of said multipiece cap.

14. A constant contact side bearing assembly for a railcar, comprising:

a housing including vertical wall structure defining a central axis for said side bearing assembly;

a non-metal spring seat arranged within said housing for vertical reciprocatory movement;

a non-metal top cap at least partially arranged within said housing for vertical reciprocatory movement, with said top cap having a generally flat surface spaced at least partially above the wall structure of said housing, with said non-metal top cap being carried by said non-metal spring seat;

a spring arranged within said housing for returning energy imparted to said side bearing assembly;

wherein said spring seat and said top cap define cooperating angled surfaces therebetween for urging said spring seat and said top cap in opposed generally horizontal directions away from the central axis of said side bearing assembly such that non-metal wall structure on each of said spring seat and said top cap is maintained in sliding engagement with the wall structure on said housing in response to a vertical load acting on said side bearing assembly while maintaining vertical reciprocity of said spring seat and said top cap relative to said housing; and an apparatus is carried by said spring seat and said top cap for allowing said spring seat and said top cap to horizontally slide relative to each other while limiting vertical separation of said spring seat and said top cap relative to each other during operation of said constant contact side bearing assembly.

15. The constant contact side bearing assembly according to claim 14 wherein, said housing and at least one of said spring seat and said top cap define cooperating instrumentalities for guiding said spring seat and said top cap for vertical reciprocatory movements relative to said housing and for maintaining a predetermined relation between said spring seat, said top cap and said housing.

16. The constant contact side bearing assembly according to claim 14 wherein, said spring includes an elastomeric member having first and second axially aligned ends.

17. The constant contact side bearing assembly according to claim 14 wherein, said apparatus on said spring seat and said top cap for allowing said spring seat and said top cap to horizontally slide relative to each other while limiting vertical separation of said spring seat and said top cap relative to each other during operation of said constant contact side bearing assembly is formed integral with said spring seat and said top cap.

18. The constant contact side bearing assembly according to claim 14 wherein, the generally flat surface of the top cap carries a metallic insert for establishing a coefficient of friction ranging between about 0.4 and about 0.9 with the railcar during operation of the side bearing assembly.

* * * * *